US006351915B1

(12) United States Patent
Puckett

(10) Patent No.: US 6,351,915 B1
(45) Date of Patent: Mar. 5, 2002

(54) COUPLING APPARATUS WITH PARALLEL MEMBERS JOINED BY AN ELASTIC OR SPRING ELEMENT PIVOTALLY INTERFACING A DRYWALL AND CURTAIN WALL MULLION

(75) Inventor: Steven A. Puckett, Duncanville, TX (US)

(73) Assignee: S&P Resources, Inc., Duncanville, TX (US)

( * ) Notice: Subject to any disclaimer, the term of this patent is extended or adjusted under 35 U.S.C. 154(b) by 0 days.

(21) Appl. No.: 09/561,354

(22) Filed: Apr. 28, 2000

(51) Int. Cl.[7] ..... E04B 1/98

(52) U.S. Cl. ..... 52/167.1; 52/235; 52/713; 52/573.1

(58) Field of Search ..... 52/167.1, 235, 52/71, 713, 483.1, 395, 481.1, 573.1, 167.2, 167.9, 582.1, 208, 204.62, 204.68, 204.69; 403/229, 220, 65, 66, 68, 71, 327, 79, 119, 120; 16/225

(56) References Cited

U.S. PATENT DOCUMENTS

| | | | | | |
|---|---|---|---|---|---|
| 4,276,729 | A | * | 7/1981 | Shiga et al. | 52/209 |
| 4,934,115 | A | * | 6/1990 | Nozaki | 52/71 |
| D423,594 | S | * | 4/2000 | Green | D20/43 |

FOREIGN PATENT DOCUMENTS

| | | | | |
|---|---|---|---|---|
| EP | 557979 A1 | * | 9/1993 | 52/167.1 |
| GB | 2193514 | * | 2/1988 | 52/582.1 |
| JP | 406288073 A | * | 10/1994 | 52/167.1 |

OTHER PUBLICATIONS

FASTrak II™, RACO Interior OfficeFronts™, "Transitions from Drywall to Exterior Glazing System", 1998 United States Aluminum, one unnumbered page, 1998.

* cited by examiner

*Primary Examiner*—Carl D. Friedman
*Assistant Examiner*—Naoko Slack
(74) *Attorney, Agent, or Firm*—Susan Myers

(57) ABSTRACT

A building includes a coupling apparatus providing an interface between a drywall and an exterior curtain wall mullion. The coupling apparatus includes a first member in contact with a first face of the exterior curtain wall mullion and a second member in contact with a second face of the exterior curtain wall mullion. The first and second members are joined by an elastic or spring element and pivotally coupled to a bracket attached to the drywall. Insulating material may be placed between the first and second members to provide sound insulation. The coupling apparatus permits inward and outward movement of the exterior curtain wall with respect to the drywall during windy conditions and side to side movement of the exterior curtain wall with respect to the drywall during earthquake conditions.

9 Claims, 3 Drawing Sheets

COUPLING APPARATUS WITH PARALLEL MEMBERS JOINED BY AN ELASTIC OR SPRING ELEMENT PIVOTALLY INTERFACING A DRYWALL AND CURTAIN WALL MULLION

TECHNICAL FIELD OF THE INVENTION

The present invention relates in general to building construction and more particularly to an apparatus for interfacing between a drywall and an exterior curtain wall mullion.

BACKGROUND OF THE INVENTION

Today's labor intensive method of finishing out the drywall to curtain wall termination has not changed since construction of the early skyscrapers like the Chrysler Building in Chicago and the Empire State Building in New York. Now, in many countries, there are requirements in building construction to provide for protection against building movement due to winds and earthquakes. However, there is no product or technique that effectively addresses the problem of interfacing the drywall and the exterior curtain wall with respect to aesthetics, function, and cost to provide appropriate protection. Therefore, it is desirable to provide a drywall to curtain wall interface that solves the problems in conventional building construction.

SUMMARY OF THE INVENTION

From the foregoing, it may be appreciated by those skilled in the art that a need has arisen for a technique to provide wind and earthquake protection in building construction. In accordance with the present invention, an apparatus for interfacing between a drywall and an exterior curtain wall mullion is provided that substantially eliminates or reduces disadvantages and problems associated with conventional building construction techniques.

According to an embodiment of the present invention, there is provided an apparatus for interfacing between a drywall and an exterior curtain wall mullion that includes a first member in contact with a first face of the exterior curtain wall mullion and a second member in contact with a second face of the exterior curtain wall mullion. The first and second members are pivotally coupled to the drywall. An elastic element couples the first member to the second member. The apparatus allows for inward and outward movement, as well as side to side motion, of the exterior curtain wall mullion with respect to the drywall.

The present invention provides various technical advantages over conventional building construction techniques. For example, one technical advantage is to provide both wind and earthquake protection for a building. Another technical advantage is to retard high and low frequency sound from passing through a building. Yet another technical advantage is to provide an easy to install, durable, and cost effective construction technique for wind, sound, and earthquake protection. Other technical advantages may be readily apparent to those skilled in the art from the following figures, description, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1:
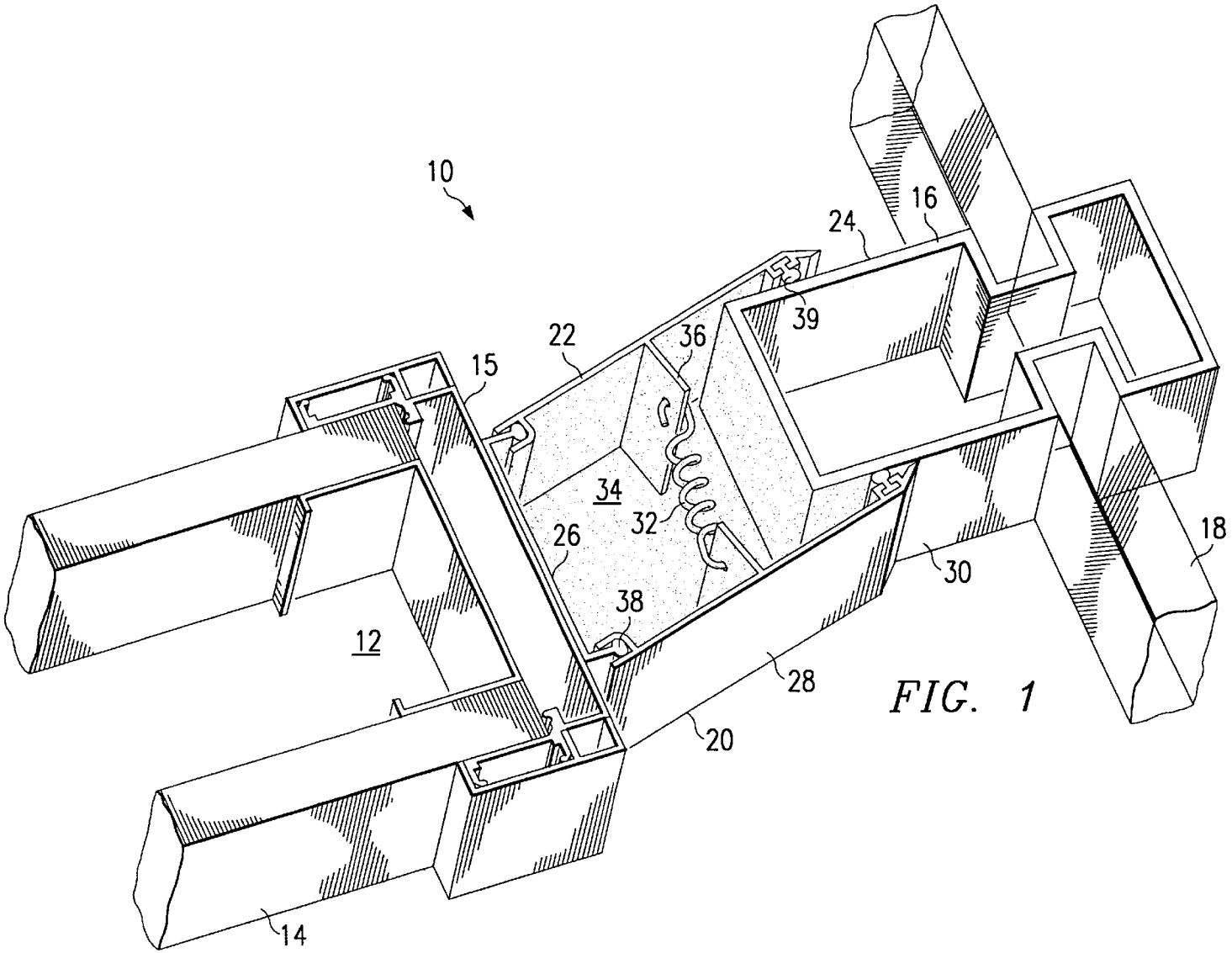
FIG. 1 illustrates a simplified schematic diagram of a building.

FIG. 1 is a simplified schematic diagram of a building 10. Building 10 includes a drywall 12, a drywall partition 14, a partition cap 15, an exterior curtain wall mullion 16, exterior glass 18, and a coupling apparatus 20. Coupling apparatus 20 provides the interface between drywall 12 and exterior curtain wall mullion 16. Coupling apparatus 20 includes a first member 22 in contact with a first face 24 of exterior curtain wall mullion 16. First member 22 is pivotally coupled to drywall 12 through a bracket 26. Coupling apparatus 20 also includes a second member 28 in contact with a second face 30 of exterior curtain wall mullion 16. Second member 28 may also be pivotally coupled to drywall 12 through bracket 26. First member 22 and second member 28 may be held in relation to each other by an elastic member 32. Additionally, there may be insulating material 34 placed between first member 22 and second member 28 for sound retardation within building 10.

Elastic member 32 may be a spring and may be attached to first member 22 and second member 28 through flanges 36 thereon. Elastic member 32 may also be made of any other conventional elastic material that will keep first member 22 and second member 28 in contact with first face 24 and second face 30 of exterior curtain wall mullion 16. First member 22 and second member 28 are preferably solid pieces of extruded aluminum that can be painted or anodized to match exterior curtain wall mullion 16. Similarly, partition cap 15 may be made of extruded aluminum and painted or anodized to match exterior curtain wall mullion 16. First member 22 and second member 28 may use a universal or any other type of joint 38 to provide the pivotal connection to bracket 26. First member 22 and second member 28 may include sound seal matter 39 at a point of contact with exterior curtain wall mullion 16 for further sound retardation within building 10.

Figure 2B:
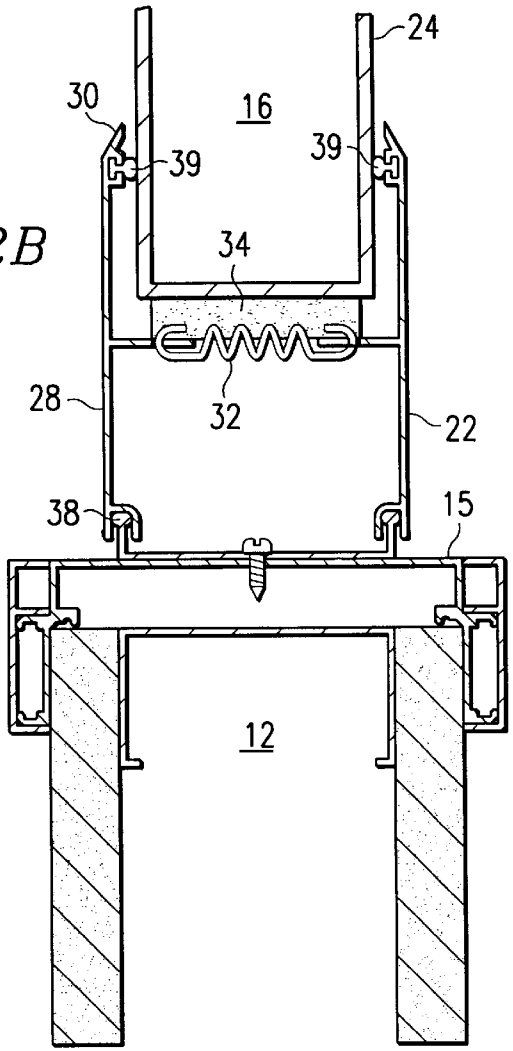
FIGS. 2A–B illustrate compensation for a inward and outward movement of the building.
Figure 2A:
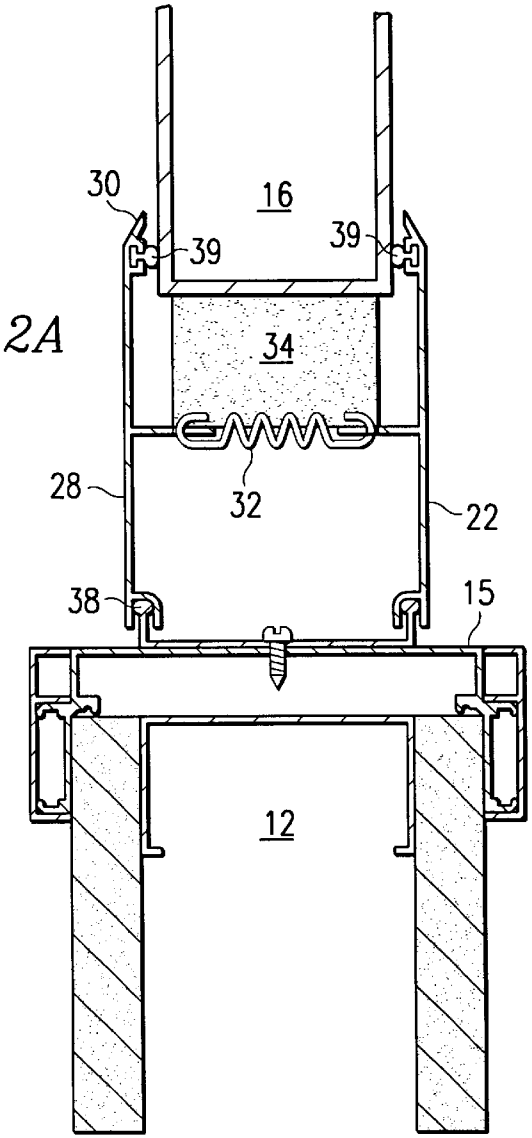

FIGS. 2A–B show operation of coupling apparatus 20 during windy conditions. As wind hits exterior glass 18 in FIG. 2A, exterior curtain wall mullion 16 moves inward between first member 22 and second member 28. As wind subsides in FIG. 2B, exterior curtain wall mullion 16 moves outward between first member 22 and second member 28. Thus, coupling apparatus 20 provides a deflection capability in windy conditions. The inward and outward movement of exterior curtain wall mullion 16 is referred to as the wind load deflection.

Figure 3B:
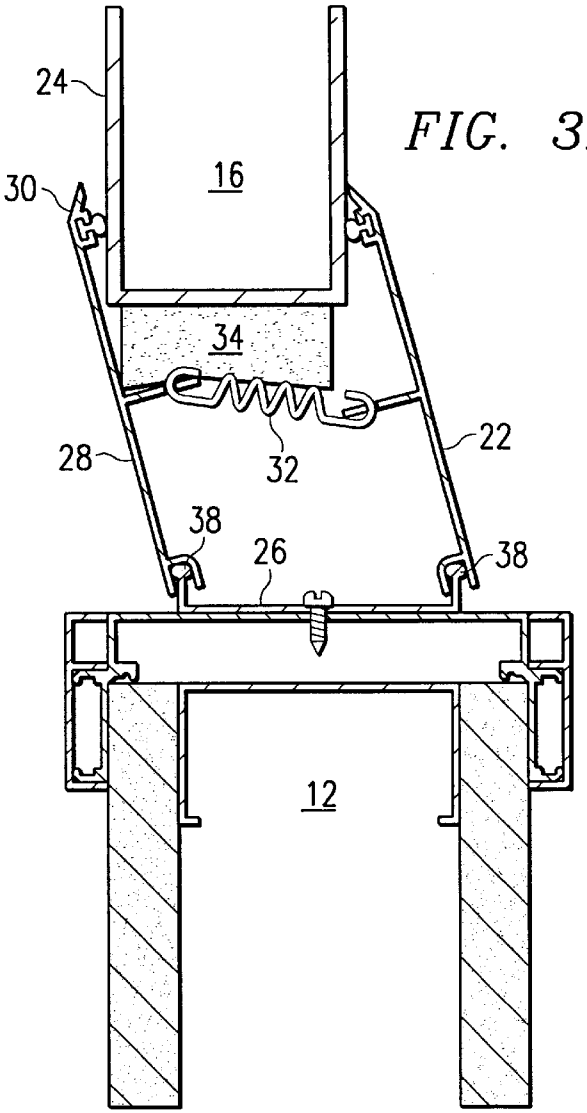
FIGS. 3A–B illustrate compensation for a sideways movement of the building.
Figure 3A:
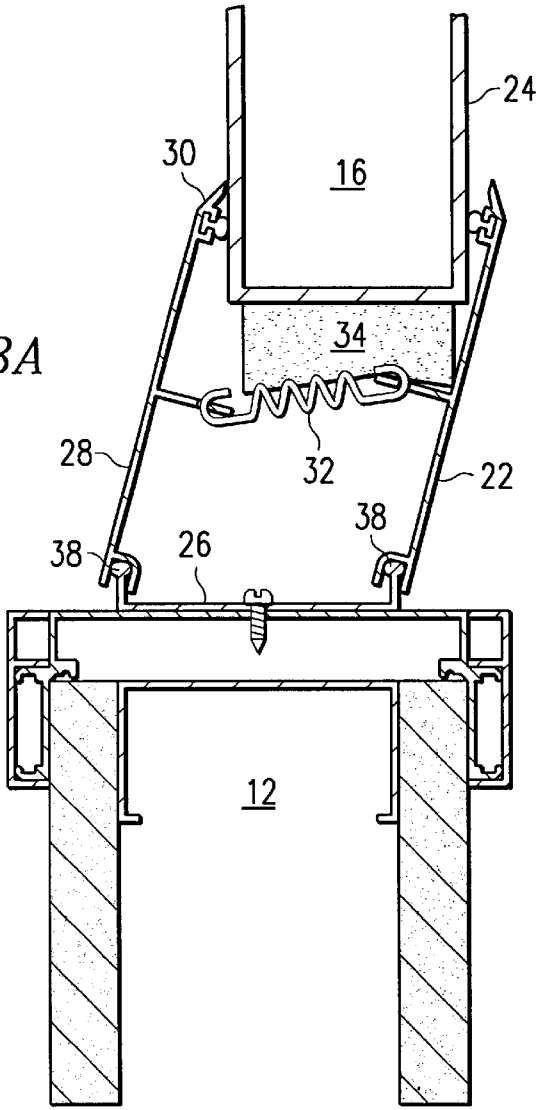

FIGS. 3A–B show operation of coupling apparatus 20 during earthquake conditions. The pivotal coupling of first member 22 and second member 28 to bracket 26 allows for exterior curtain wall mullion to move back and forth sideways in each direction as depicted in FIGS. 3A–B. Elastic member 32 keeps first member 22 in proximity with second member 28 at exterior curtain wall mullion 16 so that coupling apparatus stays together during an earthquake. Coupling apparatus 20 provides a deflection capability during earthquake conditions in order to help maintain the integrity of building 10. The sideways movement of exterior curtain wall mullion 16 shown represents the type of movement building 10 experiences during an earthquake.

Insulation material 34 and sound seal matter 39 may be any type of material that can retard high and low frequency sound. Thus, noise between interior office walls may be eliminated. Through this sound retardation, coupling apparatus 20 may be able to achieve a superior Sound Transmission Coefficient (STC) Rating. Coupling apparatus 20 is easy to install for drywall contractors, allowing it to be competitively priced when compared to conventional labor intensive construction applications. The life of coupling apparatus 20 will last for the life of building 10 or unit remodeling of the interior of building 10 is performed. Coupling apparatus 20 is designed to far outlive current techniques of addressing the drywall to curtain wall termination which may be inadequate upon installation or become ineffective after a short period of time.

Thus, it is apparent that there has been provided, in accordance with the present invention, an apparatus for interfacing between a drywall and an exterior curtain wall mullion that satisfies the advantages set forth above. Although the present invention has been described in detail, it should be understood that various changes, substitutions, and alterations may be readily ascertainable by those skilled in the art and may be made herein without departing from the spirit and scope of the present invention as defined by the following claims.

What is claimed is:

1. An apparatus for interfacing between a drywall and an exterior curtain wall mullion, comprising:

a first member operable to be in contact with a first face of the exterior curtain wall mullion;

a second member operable to be in contact with a second face of the exterior curtain wall mullion;

a bracket operable to be coupled to the drywall, the first and second members operable to be pivotally coupled to the bracket;

an elastic element coupling the first member to the second member, the elastic member operable to maintain the first and second members parallel to each other.

2. The apparatus of claim 1, wherein the first and second members are operable to allow inward and outward movement of the exterior curtain wall mullion therebetween with respect to the bracket.

3. The apparatus of claim 1, wherein the first and second members are operable to allow sideways movement of the exterior curtain wall mullion with respect to the bracket.

4. The apparatus of claim 1, wherein the elastic member is a spring.

5. An apparatus for interfacing between a drywall and an exterior curtain wall mullion, comprising:

a first member operable to be in contact with a first face of the exterior curtain wall mullion;

a second member operable to be in contact with a second face of the exterior curtain wall mullion, the first and second members operable to be pivotally coupled to the drywall;

an elastic element coupling the first member to the second member, the elastic member operable to maintain the first and second members parallel to each other;

insulation material located in between the first and second members.

6. The apparatus of claim 1, wherein the first and second members are made of aluminum.

7. An apparatus for interfacing between a drywall and an exterior curtain wall mullion, comprising:

a first member operable to be in contact with a first face of the exterior curtain wall mullion;

a second member operable to be in contact with a second face of the exterior curtain wall mullion, the first and second members operable to be pivotally coupled to the drywall;

an elastic element coupling the first member to the second member, the elastic member operable to maintain the first and second members parallel to each other;

wherein the first and second members each include a universal joint operable to provide a separate pivotal coupling to the drywall.

8. An apparatus for interfacing between a drywall and an exterior curtain wall mullion, comprising:

a first member operable to be in contact with a first face of the exterior curtain wall mullion;

a second member operable to be in contact with a second face of the exterior curtain wall mullion, the first and second members operable to be pivotally coupled to the drywall;

an elastic element coupling the first member to the second member, the elastic member operable to maintain the first and second members parallel to each other;

wherein the first and second members include sound seal matter operable to be in contact with the first and second faces of the exterior curtain wall mullion, respectively.

9. The apparatus of claim 1, wherein the first and second members include a flange to provide connection to the elastic member.

* * * * *